US005451244A

United States Patent [19]

Castledine

[11] Patent Number: 5,451,244

[45] Date of Patent: Sep. 19, 1995

[54] HIGH STRAIN RATE DEFORMATION OF NICKEL-BASE SUPERALLOY COMPACT

[75] Inventor: B. Wayne Castledine, Gregory, Mich.

[73] Assignee: Special Metals Corporation, New Hartford, N.Y.

[21] Appl. No.: 223,561

[22] Filed: Apr. 6, 1994

[51] Int. Cl.[6] ..... C22C 29/00; B22F 3/15

[52] U.S. Cl. ..... 75/243; 75/244; 75/246; 419/11; 419/28; 419/39; 419/49; 420/441

[58] Field of Search ..... 75/239, 240, 246, 243, 75/244; 419/14, 11, 15, 28, 39, 49, 60; 420/441

[56] References Cited

U.S. PATENT DOCUMENTS

| | | | |
|---|---|---|---|
| 3,639,179 | 2/1972 | Reichman et al. | 148/11.5 |
| 3,975,219 | 8/1976 | Allen et al. | 148/11.5 |
| 4,226,644 | 10/1980 | Cox et al. | 148/2 |
| 4,439,236 | 3/1984 | Ray | 75/123 B |
| 4,576,653 | 3/1986 | Ray | 148/3 |
| 4,717,435 | 1/1988 | Kawasaki et al. | 148/410 |
| 4,886,639 | 12/1989 | Andrees et al. | 419/28 |
| 5,009,704 | 4/1991 | Banik | 75/238 |
| 5,100,616 | 3/1992 | Kawasaki et al. | 420/448 |

*Primary Examiner*—Ngoclan Mai
*Attorney, Agent, or Firm*—Robert F. Dropkin

[57] ABSTRACT

A process for preparing a consolidated nickel-base superalloy compact suitable for tensile force inducing high strain rate deformation. It includes the steps of: preparing a melt of a nickel-base superalloy in a vacuum; atomizing the melt into powder in a protective atmosphere; collecting the powder; screening the powder to proper size; introducing the powder into a container; evacuating and sealing the container in a vacuum; and consolidating the powder under pressure at a temperature below the solidus temperature of the alloy and at a temperature at which grain boundaries grow past prior particle boundaries.

7 Claims, No Drawings

HIGH STRAIN RATE DEFORMATION OF NICKEL-BASE SUPERALLOY COMPACT

The present invention relates to a process for preparing a consolidated nickel-base superalloy compact for high strain rate deformation and, in particular, for tensile force inducing high strain rate deformation.

Nickel-base superalloys are usually the material of choice for aircraft gas and land gas turbines. They are capable of operating under high stress and fatigue loading at temperatures up to 2000° F., and in adverse corrosive environments.

The largest use of nickel-base superalloys has involved parts which are cast to shape or cast and wrought to a final shape. Cast and wrought nickel-base superalloys can be worked at high strain rates.

Nickel-base superalloy parts can also be formed from powder (particles of the superalloy), which is consolidated and worked to a final shape. Parts produced from powder are characterized by a reduced degree of microstructural inhomogeneity as compared to cast parts. Attempts to work consolidated powder at tensile force inducing high strain rates has, however, been met with failure due to a loss of ductility compared to the same alloy processed by cast/wrought techniques.

U.S. Pat. No. 5,009,704 discloses a process for working consolidated nickel-base superalloy powder at tensile force inducing high strain rates. The patent describes a process wherein the powder is: (a) consolidated at a temperature above the incipient melting temperature (the solidus) of the alloy to solutionize complex boride and carbide compounds but below the temperature necessary to solutionize the stable metal carbide phase; and then (b) held at a temperature below the incipient melting temperature for homogenization.

Although U.S. Pat. No. 5,009,704 discloses a process for working consolidated nickel-base superalloy powder at tensile force inducing high strain rates, it is not without its shortcomings. The high temperature (above the solidus) used in consolidating the nickel-base superalloy powder causes the superalloy's grains to grow to a size where it is difficult, if not impossible, to recrystallize the superalloy to a fine grain size. A fine grain size is necessary for a superalloy to meet its strength requirements.

Through the present invention there is provided a process which accomplishes the objective of U.S. Pat. No. 5,009,704 without the heretofore referred to shortcoming of the patented process. The present invention teaches a process for preparing a consolidated nickel-base superalloy for tensile force inducing high strain rate deformation, without consolidation at a temperature above the solidus. By consolidating at a temperature below the solidus, excessive grain growth and complications with recrystallization are avoided.

The present invention provides a process wherein a nickel-base superalloy powder is consolidated at a temperature below the solidus temperature of the superalloy but at a temperature in excess of that temperature at which grain boundaries grow past prior particle (insoluble precipitate) boundaries. The insoluble precipitates could be oxides, nitrides, carbides and/or carbonitrides. As the insoluble precipitates, which are non-ductile components, are separated from the grain boundaries through which fracture typically occurs, the high strain rate ductility of the superalloy is significantly improved. The high strain rate ductility is, moreover, improved by a process which is materially different from that of U.S. Pat. No. 5,009,704. U.S. Pat. No. 5,009,704 uses excessive temperatures to annihilate the insoluble precipitates.

The very limited temperature range of the present invention is contrary to all available indications. Although the present invention does not use the extremely high temperatures of U.S. Pat. No. 5,009,704 and the mechanism of annihilation, it does use consolidation temperatures higher than that which those skilled in the art would have been inclined to use. Those skilled in the art are aware that higher temperatures are typically accompanied by coarser grains and a loss in high strain rate ductility. They are not, however, aware of the present invention's discovery with respect to grain growth and prior particle boundaries.

It is accordingly an object of the present invention to provide a process for preparing a consolidated nickel-base superalloy compact for high strain rate deformation and, in particular, for tensile force inducing high strain rate deformation.

The present invention comprises the steps of: preparing a melt of a nickel-base superalloy in a vacuum; atomizing the melt into powder in a protective atmosphere; collecting the powder; screening the powder to proper size; introducing the powder into a container; evacuating and sealing the container in a vacuum; and consolidating the powder. The powder is consolidated under pressure at a temperature below the solidus temperature of the alloy and at a temperature in excess of that temperature at which grain boundaries grow past prior particle boundaries. Typical consolidation mechanisms are hot isostatic pressing and atmospheric pressing. Required temperatures are generally within 50° F. of the solidus and quite often within 25° F. of the solidus.

The process may include the additional step of deforming; e.g. forging or rolling, the consolidated powder at a tensile force inducing high strain rate. In particular, at a strain rate in excess of 150 in/in/min, and often in excess of 300 in/in/min.

A nickel-base superalloy typically contains at least 55%, by weight, nickel. The steps of preparing a melt, atomizing the melt, collecting and screening the powder, containerizing the powder and evacuating and sealing the container are well known to those skilled in the art.

The following examples are illustrative of several aspects of the invention.

EXAMPLE 1

A nickel-base superalloy melt having the following chemistry, by weight, was prepared in a vacuum:

| | | | |
|---|---|---|---|
| C | 0.031 | Hf | <0.0020 |
| Cr | 13.28 | V | 0.009 |
| Co | 7.84 | Ti | 2.44 |
| Mo | 3.43 | Al | 3.45 |
| W | 3.57 | B | 0.012 |
| Cb | 3.51 | Zr | 0.060 |
| Ta | 0.020 | Ni | Bal. |

The melt was argon gas atomized into powder, collected, screened to minus 140 mesh (100 microns) and placed in a stainless steel can under vacuum at a pressure of less than one micron. The can was hot isostatically pressed for approximately three hours at a pressure of about 15,000 pounds per square inch. The can was heated in an autoclave in a manner such that one end was very slightly below the solidus (2300±10° F.) while the other end was approximately 40° F. below the solidus.

The microstructure of the hot isostatically pressed compact was examined at 100X. The onset of grain growth past prior particle boundaries is evident in the material consolidated at a temperature approximately 40° F. below its solidus temperature. Significant grain growth past prior particle boundaries is evident in the material consolidated at a temperature just below its solidus temperature.

EXAMPLE 2

A nickel-base superalloy melt having the following chemistry, by weight, was prepared in a vacuum:

| | | | |
|---|---|---|---|
| C | 0.022 | Hf | <0.0020 |
| Cr | 15.89 | V | <0.010 |
| Co | 14.46 | Ti | 4.96 |
| Mo | 3.00 | Al | 2.50 |
| W | 1.34 | B | 0.016 |
| Cb | <0.01 | Zr | 0.036 |
| Ta | 0.011 | Ni | Bal. |

The melt was argon gas atomized into powder, collected, screened to minus 100 mesh (150 microns) and placed in a stainless steel can under vacuum at a pressure of less than one micron. The can was hot isostatically pressed for approximately three hours at a pressure of about 15,000 pounds per square inch. The can was heated in an autoclave in a manner such that one end was very slightly below the solidus (2300±10° F.) while the other end was approximately 40° F. below the solidus.

The microstructure of the hot isostatically pressed compact was examined at 100X. The onset of grain growth past prior particles is somewhat evident in the material consolidated at a temperature approximately 40° F. below its solidus temperature. Significant grain growth past prior particle boundaries is evident in the material consolidated at a temperature approximately 5° F. below its solidus temperature.

Material consolidated at a temperature approximately 5° F. below its solidus temperature was flat die forged, punched and successfully ring rolled without fracture. Ring rolling is tensile force inducing high strain rate deformation at a strain rate in excess of 300 in/in/min.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. In a process for preparing a consolidated nickel-base superalloy compact which is both capable of operating under high stress and fatigue loading at temperatures up to 2000° F. and suitable for tensile force inducing high strain rate deformation, which process includes the steps of: preparing a melt of a nickel-base superalloy in a vacuum; atomizing said melt into powder in a protective atmosphere; collecting said powder; screening said powder to proper size; introducing said powder into a container; evacuating and sealing the container in a vacuum; and consolidating said powder; the improvement comprising the step of consolidating said alloy, under pressure, at a temperature below the solidus temperature of said powder and at a temperature in excess of a temperature at which grain boundaries grow past prior particle boundaries, said particles being insoluble precipitates.

2. The process according to claim 1, wherein said powder is consolidated at a temperature below, but within 50° F. of, the solidus temperature of said alloy.

3. The process according to claim 1, wherein said powder is consolidated at a temperature below, but within 25° F. of, the solidus temperature of said alloy.

4. The process according to claim 1, further including the step of deforming said consolidated powder at a tensile force inducing strain rate in excess of 150 in/in/-min.

5. The process according to claim 4, wherein said consolidated powder is deformed at a tensile force inducing strain rate in excess of 300 in/in/min.

6. The process according to claim 1, wherein said consolidation is hot isostatic pressing.

7. A nickel-base superalloy prepared in accordance with the process of claim 1.

* * * * *